US009596721B2

(12) United States Patent
Shan et al.

(10) Patent No.: US 9,596,721 B2
(45) Date of Patent: Mar. 14, 2017

(54) METHOD FOR PROTECTING SWITCHING ELEMENTS IN AN INDUCTION HEATING SYSTEM

(71) Applicant: General Electric Company, Schenectady, NY (US)

(72) Inventors: Mingwei Shan, Louisville, KY (US); Gregory Francis Gawron, Sr., Jeffersontown, KY (US); Daniel Vincent Brosnan, Louisville, KY (US); John Michael Kulp, Jr., Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1097 days.

(21) Appl. No.: 13/740,520

(22) Filed: Jan. 14, 2013

(65) Prior Publication Data

US 2014/0197160 A1 Jul. 17, 2014

(51) Int. Cl.
*H05B 6/06* (2006.01)
*H05B 6/08* (2006.01)

(52) U.S. Cl.
CPC ..... *H05B 6/062* (2013.01)

(58) Field of Classification Search
CPC ..... H05B 6/06; H05B 6/062; H05B 6/065
USPC ..... 219/488, 494, 497, 626–627, 660, 219/663–667
See application file for complete search history.

(56) References Cited

U.S. PATENT DOCUMENTS 5,324,906 A * 6/1994 Dong ..... H05B 6/062 219/626
5,450,305 A * 9/1995 Boys ..... G05F 1/13 219/624
7,282,680 B2 10/2007 Ryu
2012/0261405 A1* 10/2012 Kurose ..... H05B 6/44 219/620
2012/0285948 A1* 11/2012 Shan ..... H05B 6/062 219/660
2012/0294990 A1* 11/2012 Graber ..... H05B 6/062 426/231

FOREIGN PATENT DOCUMENTS

KR 20040102915 12/2004

* cited by examiner

*Primary Examiner* — Dana Ross
*Assistant Examiner* — Lindsey C Staubach
(74) *Attorney, Agent, or Firm* — Dority & Manning, P.A.

(57) ABSTRACT

The present disclosure provides systems and methods for protecting switching elements in an induction heating system. A switching power loss associated with a switching element of the induction heating system can be calculated and an operating frequency of the induction heating system can be adjusted based upon the switching power loss. According to one aspect, the switching power loss can be classified into one of a plurality of threat zones based upon the magnitude of the switching power loss and the operating frequency can be adjusted based upon the threat zone into which the switching power loss is classified. According to another aspect, the switching power loss can be calculated based at least in part on a duty cycle of an output signal. The duty cycle of the output signal can provide an indication of the proximity of the operating frequency of the induction heating system to resonance.

11 Claims, 9 Drawing Sheets

METHOD FOR PROTECTING SWITCHING ELEMENTS IN AN INDUCTION HEATING SYSTEM

FIELD OF THE INVENTION

The present disclosure relates to induction heating. More particularly, the present disclosure relates to systems and methods for protecting switching elements in an induction heating system.

BACKGROUND OF THE INVENTION

Induction heating systems such as induction cooktops can be used to heat cooking utensils by magnetic induction. A resonant power inverter can be used to supply a chopped DC power signal through a heating coil. This can generate a magnetic field, which can be magnetically coupled to a conductive object or vessel, such as a pan, placed over the heating coil. The magnetic field can generate eddy currents in the vessel, causing the vessel to heat.

A typical resonant power inverter circuit is illustrated in FIG. 1. As shown, the induction heating coil 114 can receive a power signal 101 that is supplied through a resonant power inverter, referred to herein as a resonant inverter module 112. The resonant inverter module 112 can be generally configured to generate a high frequency power signal from AC power source 108 at a desired operating frequency to the induction heating coil 114. The load of the resonant inverter module 112 can generally include the induction heating coil 114 and any object or vessel that is present on the induction heating coil 114. The object or vessel on the induction heating coil 114, such as for example a pan, will be generally referred to herein as a vessel.

The resonant inverter module 112 can be coupled to AC power source 108. The resonant inverter module 112 can be provided with switching elements Q1 and Q2, which can provide power to the load, including the induction heating coil 114 and any vessel or object thereon. The direction A, B of the current flow through the induction heating coil 114 can be controlled by the switching of switching elements Q1 and Q2. Switching unit 130 can provide the controlled switching of the switching elements Q1, Q2 based on a switching control signal provided from controller 120. In typical known applications, controller 120 can be configured to control switching unit 130 based on signals from a current transducer or current transformer 110.

Switching elements Q1 and Q2 can be insulated-gate bipolar transistors (IGBTs) and the switching unit 130 can be a Pulse Width Modulation (PWM) controlled half bridge gate driver integrated circuit. In alternate embodiments, any suitable switching elements can be used, other than IGBTs. Snubber capacitors C2, C3 and resonant capacitors C4, C5 can be connected between a positive power terminal and a negative power terminal to successively resonate with the induction heating coil 114. The induction heating coil 114 can be connected between the switching elements Q1, Q2 and can induce an eddy current in the vessel (not shown) located on or near the induction heating coil 114. In particular, the generated resonant currents can induce a magnetic field coupled to the vessel, inducing eddy currents in the vessel. The eddy currents can heat the vessel on the induction heating coil 114 as is generally understood in the art.

The resonant inverter module 112 can power the induction heating coil 114 with high frequency current. The switching of the switching elements Q1 and Q2 by switching unit 130 can control the direction A, B and frequency of this current. In one embodiment, this switching can occur at a switching frequency in a range that is between approximately 20 kHz to 50 kHz. When the cycle of the switching control signal from the switching unit 130 is at a high state, switching element Q1 can be switched ON and switching element Q2 can be switched OFF. When the cycle of the switching control signal is at a low state, switching element Q2 can be switched ON and switching element Q1 can be switched OFF. When switching element Q1 is triggered on, a positive voltage is applied to the coil and the current of the power signal 101 flows through the induction heating coil 114 in the direction of B initially and then transitions to the A direction. When switching element Q2 is triggered on, a negative voltage is applied to the coil and the current of the power signal 101 flows through the induction heating coil 114 in direction of A initially and then transitions to the B direction.

If switching element Q1 is turned on and switching element Q2 is turned off, the resonance capacitor C5 and the induction coil 114 (including any vessel thereon) can form a resonant circuit. If the switching element Q1 is turned off and switching element Q2 is turned on, the resonance capacitor C4 and the induction coil 114 (including any vessel thereon) can form the resonant circuit.

To properly drive an induction coil using a resonant power inverter, such as the resonant power inverter depicted in FIG. 1, it is important to have an accurate assessment of the resonant frequency of the resonant power inverter being used to drive the induction coil. In particular, the output power of the induction coil is a function of the input, the coil inductance, vessel resistance and resonant frequency of the system. The closer the system is driven to resonant frequency, the more power can be delivered to the system. Maximum output can occur at resonance and subsequently lower power levels can be driven away from resonance accordingly.

One drawback of operating an induction heating system using a resonant power inverter circuit such as the circuit illustrated in FIG. 1 is that the switching elements can experience a "hard" switch-off. For example, FIG. 2A provides an exemplary graphical depiction of current and voltage levels associated with a switching element and an induction heating coil of a typical known resonant power inverter circuit. In particular, FIG. 2A shows a coil current 202, a switching element current 204, and a switching element voltage 206. For example, coil current 202 can be the current flowing through induction heating coil 114 of FIG. 1, switching element current 204 can be the current flowing through switching element Q1 of FIG. 1, and switching element voltage 206 can be the voltage across switching element Q1 of FIG. 1.

When resonant inverter module 112 is operated in the fashion discussed above, switching elements Q1 and Q2 switch on and off when coil current is at its peak amplitude. For example, as depicted in FIG. 2A, switching element Q1 is switched off at time t, when coil current 202 is at its peak amplitude. Switching element Q2 (voltage and current not depicted) will then be switched on. In such fashion, the voltage across the induction heating coil can be reversed. However, when switching element Q1 is switched off at time t, switching element Q1 can experience a switching power loss. Such switching loss can be generally proportional to the corresponding coil current. Thus, when the peak amplitude of coil current 202 is relatively high, the resulting switching power loss can exceed the switching element's safe operating area and the switching element can be damaged.

Excessive switching power loss is especially problematic in the instance in which a vessel that is magnetically coupled to the induction heating coil is removed or otherwise shifted away from the induction heating coil. For example, FIG. 2B provides an exemplary graphical depiction of peak coil current levels versus operating frequency of an induction heating coil with and without an associated vessel. In particular, plot 208 depicts peak coil current versus operating frequency for an induction heating coil with an associated vessel. As shown in FIG. 2B, peak coil current for an induction heating coil with an associated vessel can be maximized at resonance frequency 210. Similarly, plot 212 depicts peak coil current versus operating frequency for an induction heating coil without an associated vessel. Plot 212 can reach a maximum peak coil current at resonance frequency 214.

Removing or otherwise shifting the vessel away from the induction coil can result in a reduction in peak coil current and, therefore, a reduction in power output. As an example, with reference to FIG. 2B, removing the vessel from the induction heating coil can cause the peak coil current to shift from plot 208 to plot 212, which can correspond to a decrease in peak coil current and power output at frequencies above resonance frequency 210. In response, the induction heating system can decrease the operating frequency in an attempt to maintain a target or desired power output. Such decrease in operating frequency increases peak coil current and can result in an increased switching power loss experienced by a switching element. However, if the operating frequency is driven too low, the switching power loss can increase to an excessive, damaging amount.

Thus, systems and methods for protecting switching elements in an induction heating system are desirable.

BRIEF DESCRIPTION OF THE INVENTION

Aspects and advantages of the invention will be set forth in part in the following description, or may be obvious from the description, or may be learned through practice of the invention.

One exemplary embodiment of the present disclosure is directed to a method of operating an induction heating system. The method can include calculating a switching power loss associated with a switching element of the induction heating system. The switching element can be a component of a power supply circuit configured to supply a power signal to an induction heating coil at an operating frequency. The method can further include adjusting the operating frequency of the induction heating system based at least in part on the switching power loss.

Another exemplary embodiment of the present disclosure is directed to an induction heating system. The induction heating system can include an induction heating coil operable to inductively heat a load with a magnetic field. The induction heating system can further include a power supply circuit configured to supply a power signal to the induction heating coil at an operating frequency. The power supply circuit can include at least one switching element. The induction heating system can include a detector circuit configured to detect a feedback signal associated with a signal flowing through the induction heating coil. The detector circuit can provide and output signal have a duty cycle. The duty cycle of the output signal can be based at least in part on a percentage of the feedback signal that is greater or less than a reference signal, the duty cycle of the output signal corresponding to the proximity of the operating frequency to resonance of the induction heating system. The induction heating system can further include a control circuit configured to control the power supply circuit. The control circuit can be further configured to calculate a switching power loss associated with the at least one switching element based at least in part on the duty cycle of the output signal. The control circuit can be further configured to adjust the operating frequency of the induction heating system based at least in part on the switching power loss.

A further exemplary embodiment of the present disclosure is directed to a method for protecting a switching element of a power supply circuit in an induction cooktop. The method can include calculating a switching power loss associated with the switching element. The method can further include classifying the switching power loss into one of a plurality of threat zones based upon the magnitude of the switching power loss. The method can include adjusting an operating frequency of the power supply circuit based upon the threat zone into which the switching power loss is calculated.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
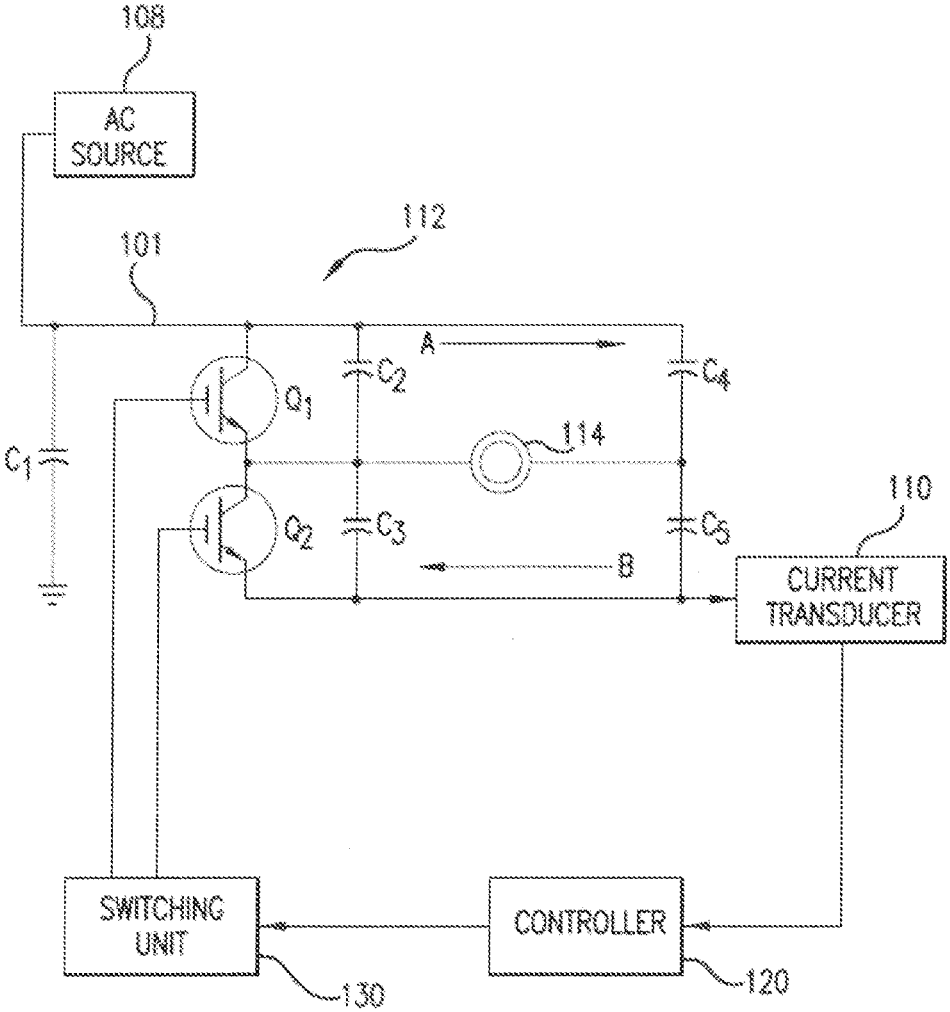
FIG. 1 (PRIOR ART)
FIG. 1 provides a circuit diagram of a typical known resonant power inverter circuit for supplying power to an induction heating coil.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure is directed to systems and methods for protecting switching elements in an induction heating system. In particular, a switching power loss associated with a switching element of the induction heating system can be calculated and an operating frequency of the induction heating system can be adjusted based upon the switching power loss.

According to one aspect of the present disclosure, the calculated switching power loss can be classified into one of a plurality of threat zones based upon the magnitude of the switching power loss. Further, the operating frequency of the induction heating system can be adjusted based upon the threat zone into which the switching power loss is classified.

According to another aspect of the disclosure, the switching power loss can be calculated based at least in part on a duty cycle of an output signal. The duty cycle of the output signal can be based upon a percentage of a feedback signal that is greater or less than a reference signal. The feedback signal can be captured using a shunt resistor coupled to the induction heating system. Further, the duty cycle of the output signal can provide an indication of the proximity of the operating frequency of the induction heating system to resonance.

The systems and methods of the present disclosure are described with reference to an induction cooking system. Those of ordinary skill in the art, using the disclosures provided herein, will appreciate that the systems and methods of the present disclosure are more broadly applicable to many resonant power supply technologies.

Figure 3:
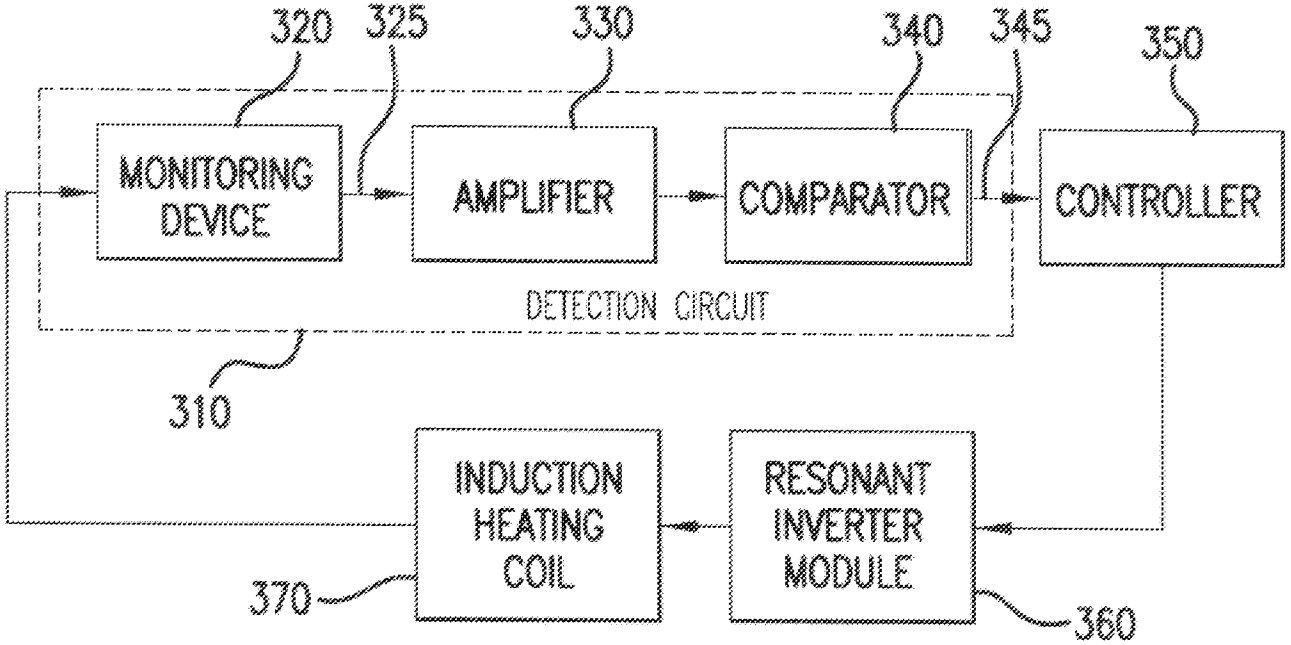
FIG. 3 provides a block diagram of an induction heating system according to an exemplary embodiment of the present disclosure.

FIG. 3 is a schematic block diagram of an induction heating system 300 according to an exemplary embodiment of the present disclosure. The induction heating system 300 can include a detection circuit 310, a controller 350, a power supply circuit such as resonant inverter module 360, and an induction heating coil 370. The resonant inverter module 360 can be configured to supply a chopped DC power signal to induction heating coil 370 at a desired operating frequency. The topology of the resonant inverter module 360 can be similar to the known resonant inverter topology depicted in FIG. 1.

Referring still to FIG. 3, the detection circuit 310 can include a monitoring device 320. Monitoring device 320 can be configured to detect and measure a current flow through induction heating coil 370. The monitoring device 320 can generate a feedback signal 325 associated with the current flow through the induction heating coil 370. The feedback signal 325 can be amplified at amplifier 330 and can be provided to comparator 340. Those of ordinary skill in the art, using the disclosures provided herein, will understand that other signal conditioning devices, such as filters, shifters, analog-to-digital converters, etc., can be used to condition the feedback signal for processing.

Comparator 340 can be configured to compare the feedback signal 325 with a reference signal to generate an output signal 345 that can be provided to controller 350. The output signal 345 can have a duty cycle that is based on the percentage of the feedback signal 325 that is greater or less than the reference signal for one period of the feedback signal 325. In one implementation, the output signal 345 can be provided to an analog-to-digital converter. In such implementation, the duty cycle can be the average digital value output by the analog-to-digital converter for one period of the feedback signal divided by the maximum digital value available. As will be discussed in more detail below, the duty cycle of the output signal 345 provides information to the controller 350 concerning the proximity of the operating frequency of the induction heating system 300 to resonance. The duty cycle of the output signal 345 can also be used to calculate a switching power loss associated with a switching element included in resonant inverter module 360.

The controller 350 can be configured to control the resonant inverter module 360 based at least in part on the duty cycle of the output signal 345 of the detection circuit 310. For instance, in a particular embodiment, the controller 350 can be configured to calculate a switching power loss associated with a switching element of resonant inverter module 360 and adjust the operating frequency of the resonant inverter module 360 to protect the switching element from excessive and damaging switching power losses.

In one implementation of the present disclosure, the operating frequency of the resonant inverter module 360 is adjusted such that the switching power loss associated with the switching element is within a safe operating area associated with the switching element. In another implementation, the switching power loss calculated by the controller 350 can be classified into one of a plurality of threat zones based upon the magnitude of the switching power loss and the operating frequency of the resonant inverter module 360 can be adjusted based upon the threat zone into which the switching power loss is classified. The control of the operation frequency based on the calculated switching power loss will be discussed in more detail below with respect to FIGS. 11A and 11B.

Figure 4:
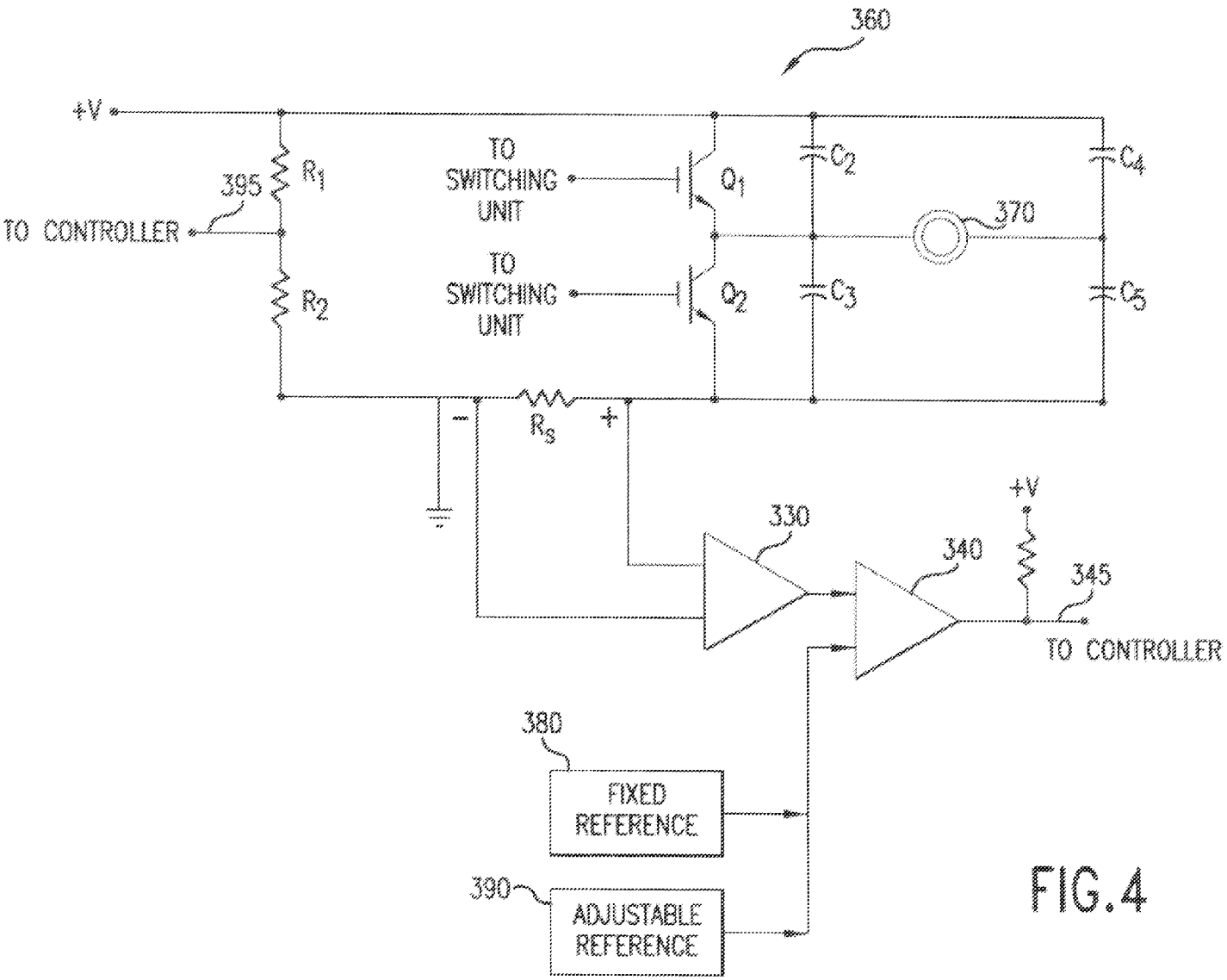
FIG. 4 provides a circuit diagram of an induction heating system according to an exemplary embodiment of the present disclosure.

FIG. 4 illustrates a circuit diagram of an exemplary induction heating system 300 that can monitor a feedback signal across a shunt resistor Rs in a return path of the current flowing through an induction heating coil 370. The system 300 can include a resonant inverter module 360 configured to supply a chopped DC power signal to induction heating coil 370. The resonant inverter module 360 can have a topology similar to the known resonant inverter module 112 depicted in FIG. 1. As illustrated, switching devices Q1 and Q2 can be controlled by a switching unit to provide chopped DC power to induction heating coil 370.

The system 300 can include a shunt resistor Rs in a return path of the current flowing through the induction heating coil 370. The feedback signal 325 for the induction heating system 300 can include the voltage across the shunt resistor Rs. The system 300 can further determine an input voltage using voltage detection signal 395.

Figure 5:
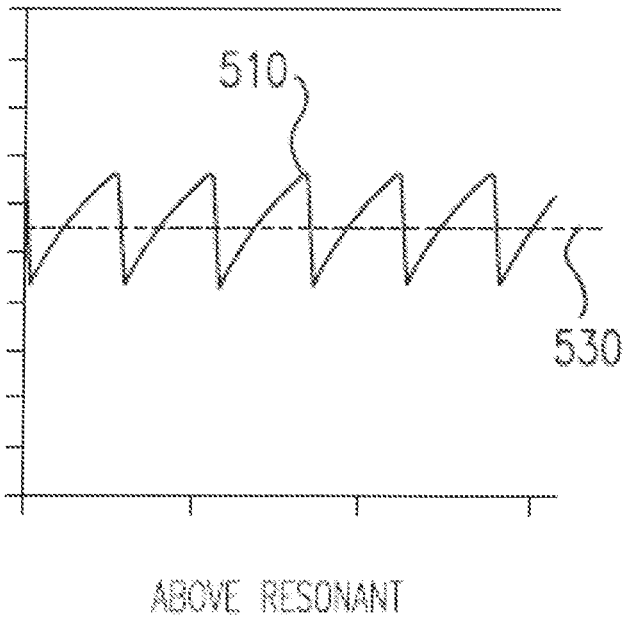
FIG. 5 provides a graphical depiction of feedback signal across a shunt resistor in a return path of the current flowing through an induction heating coil at an operating frequency above resonance according to an exemplary embodiment of the present disclosure.

FIG. 5 illustrates an exemplary plot of a feedback signal 325 across the shunt resistor Rs at an operating frequency above resonance. As illustrated by curve 510, the feedback signal looks purely reactive at operating frequencies above resonance in that there is the same amount of signal above and below the reference line 530 (0A line).

Figure 6:
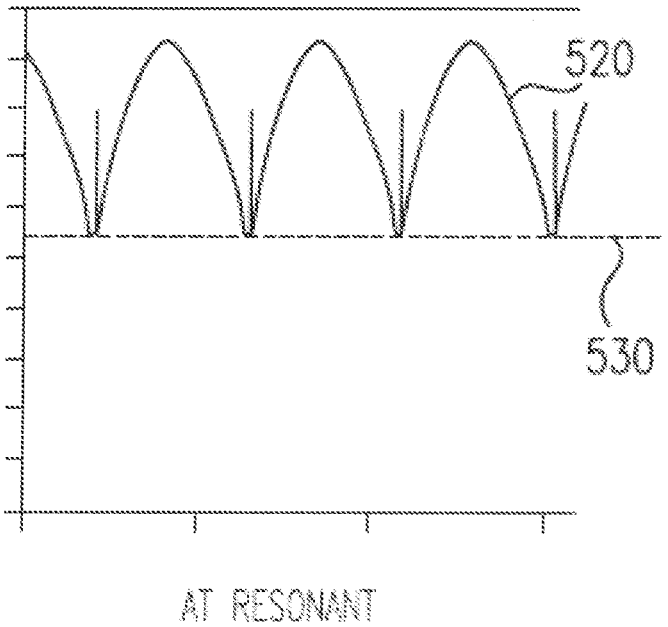
FIG. 6 provides a graphical depiction of feedback signal across a shunt resistor in a return path of the current flowing through an induction heating coil at an operating frequency at or close to resonance according to an exemplary embodiment of the present disclosure.

FIG. 6 illustrates an exemplary plot of a feedback signal 325 across the shunt resistor Rs at an operating frequency at or close to resonance. As shown by curve 520, the signal begins to look purely real when the system 300 is operating near resonance and the entire wave form is located above the reference line 530. In this regard, the proximity of the frequency to resonance can be monitored by monitoring the duty cycle of the feedback signal across shunt resistor Rs. The duty cycle provides a measure of the percentage of the feedback signal that is above or below the reference line for one period of the feedback signal.

Referring back to FIG. 4, the voltage across Rs can be provided to an amplifier 330 configured to amplify the feedback signal 325. Those of ordinary skill in the art, using the disclosures provided herein, should understand that the feedback signal 325 can provided to other signal conditioning devices as desired.

The output of the amplifier 330 can provide an input to the comparator 340. Comparator 340 can compare the amplified feedback signal to a reference signal. The reference signal can be either a fixed reference 380 or an adjustable reference 390. The adjustable reference 390 can allow the detection circuit to be adjusted to compensate for noise and/or other system offsets.

The output signal 345 of the comparator 340 can have a duty cycle based on the percentage of the feedback signal that is above or below the reference signal, depending on the configuration of the comparator 340. For instance, in a particular implementation, the output signal 345 can have a duty cycle that is based on a percentage of the feedback signal that is above the reference signal. In another particular implementation, the output signal 345 can have a duty cycle that is based on a percentage of the feedback signal that is below the reference signal.

Figure 7:
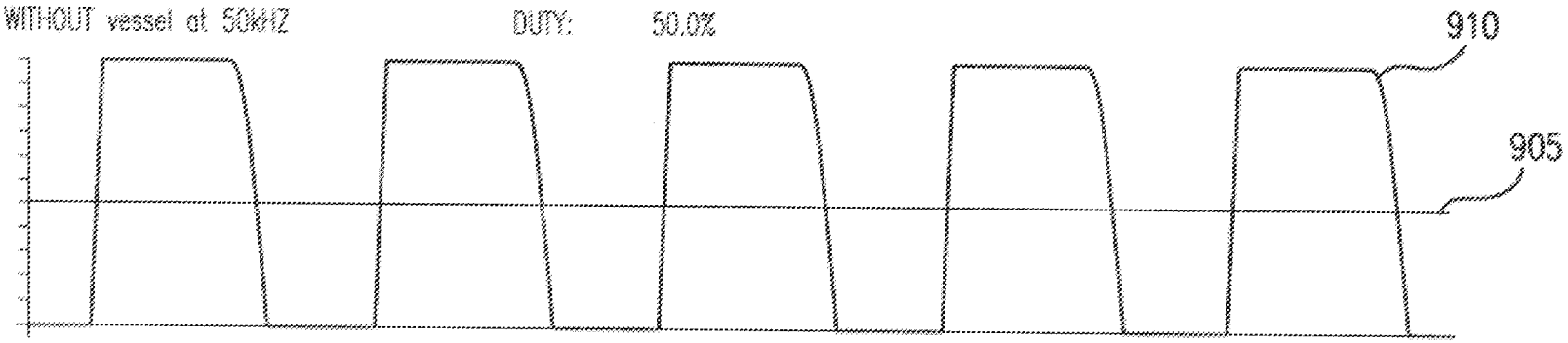
FIGS. 7-10 provide graphical depictions of output signals of a detection circuit according to an exemplary embodiment of the present disclosure.

FIGS. 7-10 provide graphical depictions of an output signal 345 at varying operating frequencies and at varying loads on the induction heating coil 370. FIG. 7 depicts a graphical representation of an output signal 910 at an operating frequency of about 50 kHz and with no vessel located on the induction heating coil 370. As illustrated, approximately 50% of the output signal 910 is above the reference line 905. This indicates that the feedback signal is greater or less (depending on the configuration of the comparator) than the reference signal for approximately 50% of the cycle for one period. The output signal 910 therefore has a duty cycle of 50%. A duty cycle of 50% provides an indication that the induction heating system is operating at a frequency that is well above resonance.

Figure 8:
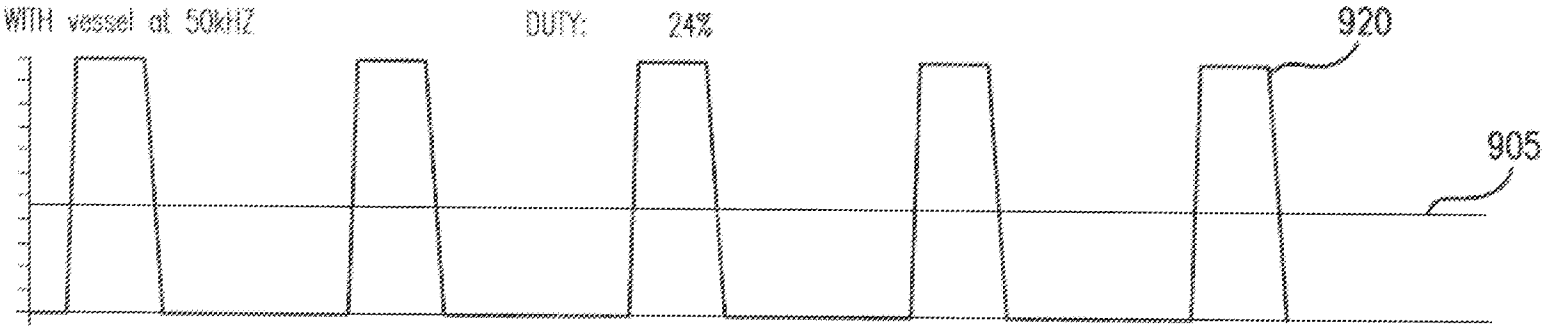

FIG. 8 provides a graphical representation of an output signal 920 at an operating frequency of about 50 kHz but with a vessel located on the induction heating coil 370. As illustrated, approximately 24% of the output signal is above the reference line 905. This indicates that the feedback signal is greater or less (depending on the configuration of the comparator) than the reference signal for approximately 24% of the cycle for one period. The output signal 920 therefore has a duty cycle of 24%. The approximately 26% change in duty cycle from output signal 910 to output signal 920 occurs due to the placement of a vessel on the induction heating coil 370. The placement of the vessel on the induction heating coil 370 alters the resonant frequency of the system such that the 50 kHz operating frequency is closer to resonance. Because the placement of the vessel on the induction heating coil resulted in a significant change in the duty cycle of the output signal, changes in the duty cycle of the output signal can be monitored to determine the presence or absence of a vessel on the induction heating coil 370.

Figure 9:
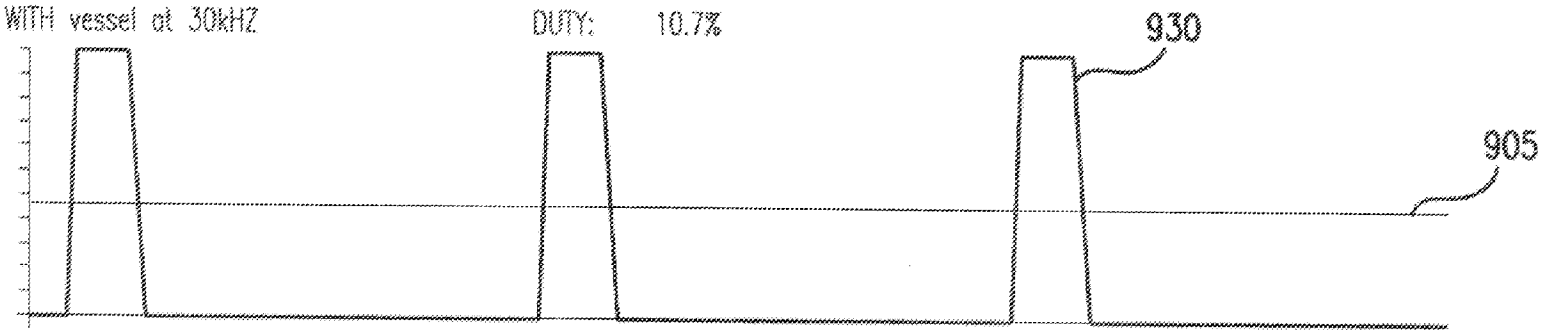

FIG. 9 provides a graphical representation of an output signal 930 at an operating frequency of about 30 kHz with a vessel located on the induction heating coil. As illustrated, approximately 10.7% of the output signal 930 is above the reference line. This indicates that the feedback signal is greater or less (depending on the configuration of the comparator) than the reference signal for approximately 10.7% of the cycle for one period. The output signal 930 therefore has a duty cycle of 10.7%. The lower duty cycle of 10.7% indicates that the operating frequency is closer to resonance.

Figure 10:
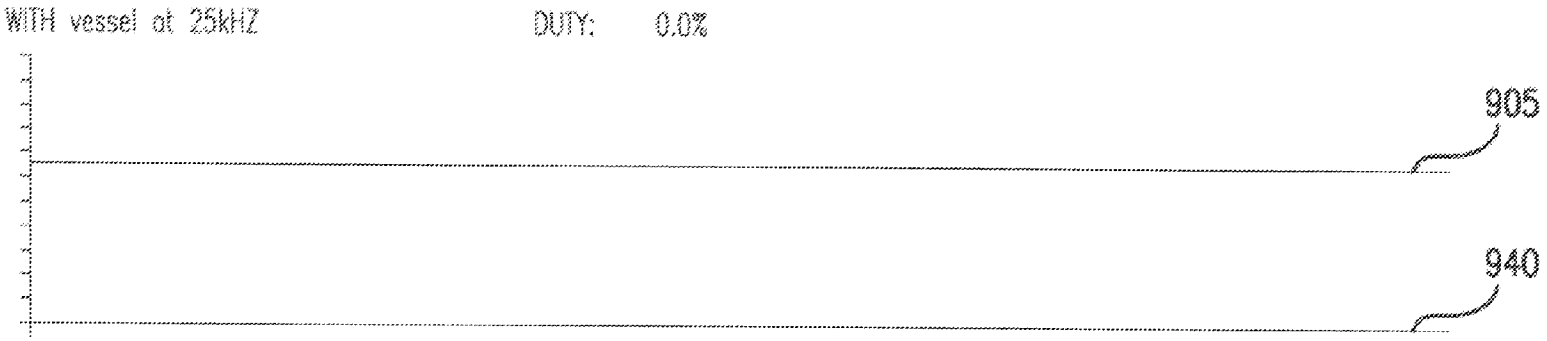

FIG. 10 provides a graphical representation of an output signal 940 at an operating frequency of about 25 kHz with a vessel located on the induction heating coil 370. As illustrated, the entire output signal 940 is located below the reference line 905. This indicates that the feedback signal is always greater or less (depending on the configuration of the comparator) than the reference signal for an entire cycle. The duty cycle of the output signal 940 is about 0%, indicating the system is operating close to or at resonance. As demonstrated by the various output signals set forth in FIGS. 7-10, the proximity of a resonant induction system to resonance can be monitored by monitoring the duty cycle of the output signal.

Figure 11A:
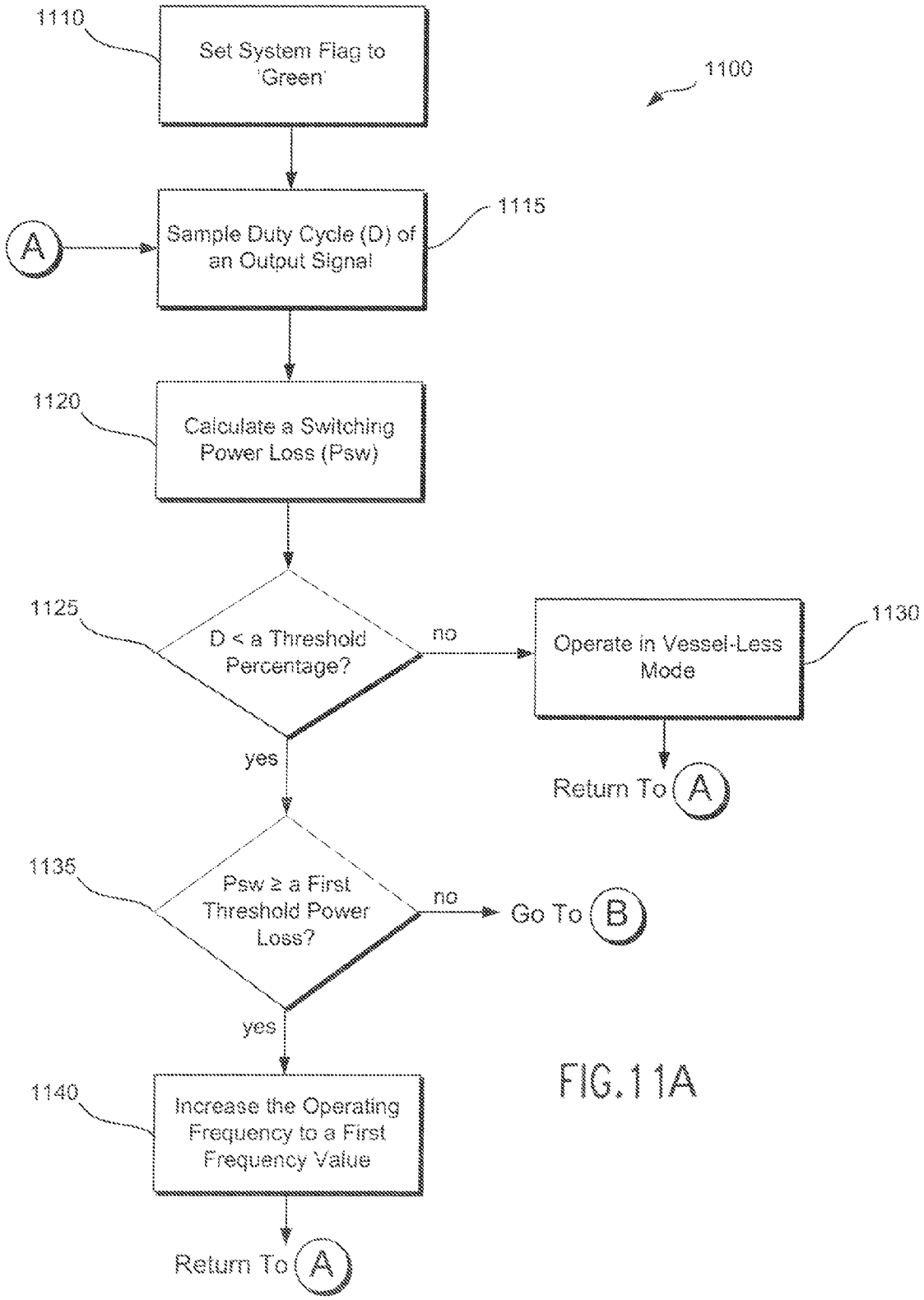
FIGS. 11A and 11B provide a flow chart of an exemplary method for operating an induction heating system according to an exemplary embodiment of the present disclosure.
Figure 11B:
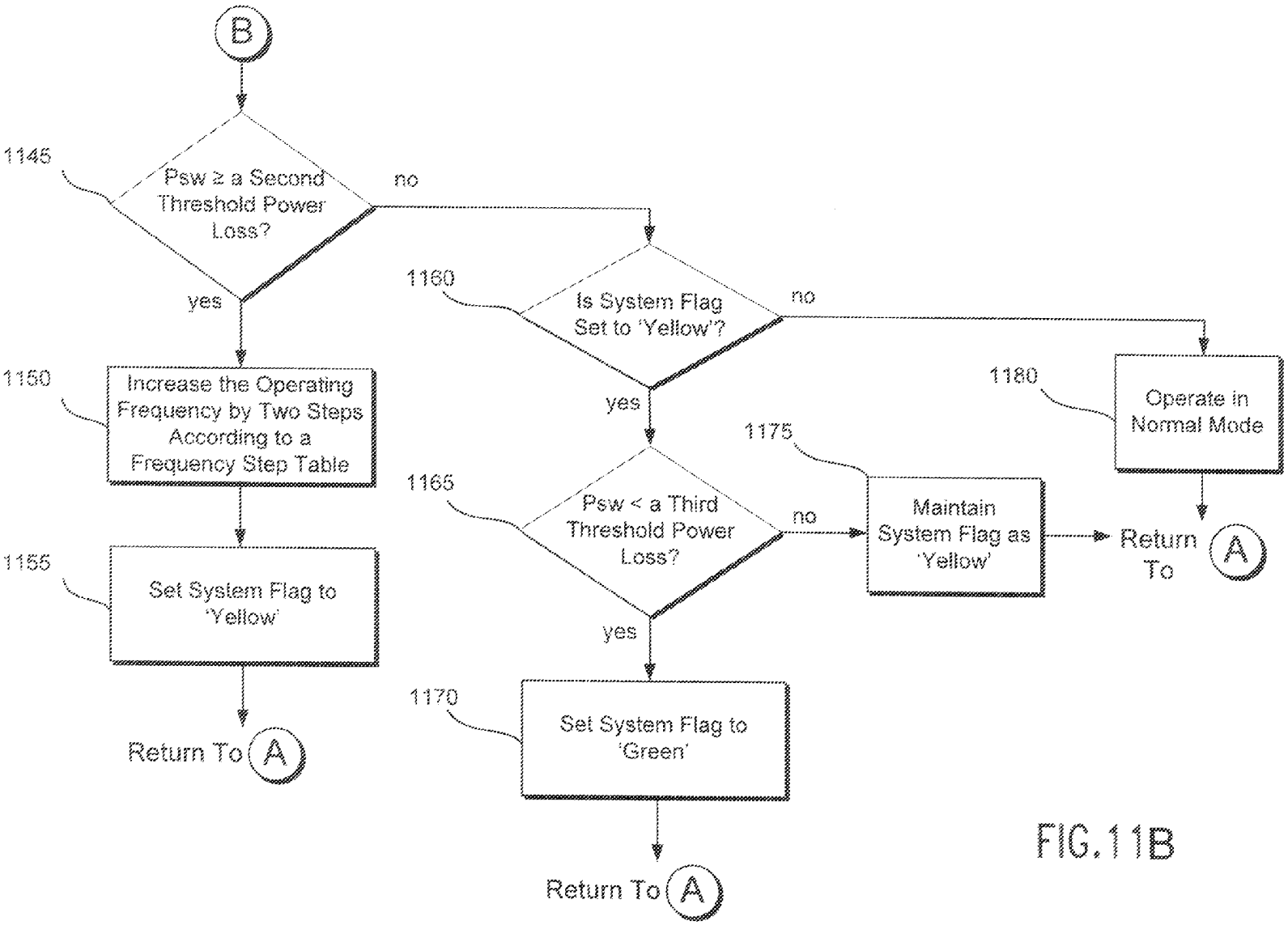

FIGS. 11A and 11B provide a flow chart of an exemplary method (1100) for operating an induction heating system according to an exemplary embodiment of the present disclosure. In particular, exemplary method (1100) can protect switching elements in an induction heating system by calculating a switching power loss associated with a switching element of the induction heating system. Further, exemplary method (1100) can adjust an operating frequency of the induction heating system based upon the switching power loss.

Although exemplary method (1100) will be discussed with reference to the exemplary induction heating system depicted in FIG. 4, exemplary method (1100) can be implemented using any suitable induction heating system or system. In addition, although FIGS. 11A and 11B depict steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

Referring now to FIG. 11A, at (1110) a system flag is set to an indicator level. For example, the system flag can be set to 'Green.' Setting the system flag to 'Green' can be a default starting point for the induction heating system. In general, when the system flag is set to 'Green,' the induction heating system can operating according to a default or normal operating mode.

At (1115) the duty cycle ("D") of an output signal is sampled. For example, a duty cycle associated with signal 345 of FIG. 4 can be sampled for one or more periods. The output signal 345 of the comparator 340 can have a duty cycle based on the percentage of a feedback signal that is above or below a reference signal (e.g. 50%). Such duty cycle can correspond to the proximity of an operating frequency of the induction heating system to resonance.

In one implementation of the present disclosure, output signal 345 of FIG. 4 can be provided to a 12-bit analog-to-digital ("A/D") converter and the duty cycle can be the average of the output of the A/D converter for one period the feedback signal. For example, if the average output of the A/D converter for one period of the feedback signal is 2048 out of a full scale 4096, then the duty cycle can be represented by the value 2048. Alternatively, the duty cycle can be represented by the average output divided by the full scale output. For example, the averaged output of 2048 can be divided by the full scale output of 4096 and the duty cycle can be represented as 50%.

At (1120) a switching power loss ("Psw") associated with a switching element of the induction heating system is calculated. As an example, the Psw can be calculated based at least in part on the duty cycle of the output signal sampled at (1115). For example, a Psw associated with switching element Q1 of FIG. 4 can be calculated at (1120).

In one implementation of the present disclosure, the Psw is calculated based upon an input voltage of a power signal supplied to the induction heating coil, a coil current flowing through the induction heating coil, and the duty cycle of the output signal sampled at (1115). For example, the input voltage of the power signal can be determined using voltage detection signal 395 of FIG. 4. Further, the coil current flowing through the induction heating coil can be determined based upon a shunt current flowing through shunt resistor Rs of FIG. 4 and the duty cycle of output signal 345 of FIG. 4. Using the input voltage, the coil current, and the duty cycle, a Psw associated with a switching element of the induction heating system can be calculated at (1120).

One of skill in the art, in light of the disclosures contained herein, will appreciate that there are many and various ways to calculate a switching power loss in addition to the exemplary methods discussed herein. Any of such methods can be used to generally satisfy the present disclosure and, in particular, step (1120).

At (1125) the sampled duty cycle ("D") is compared to a threshold duty cycle, represented in FIG. 11A as a threshold percentage, to determine whether a vessel is present on the induction heating coil. As an example, it can be checked at (1125) whether D is less than a threshold percentage of 43%. As another example, in the instance in which the duty cycle is represented by the average output of a 12-bit A/D converter for one period of the feedback signal, it can be checked at (1125) whether D is less than a threshold duty cycle of 1750.

One of skill in the art, in light of the disclosures contained herein, will appreciate that the exemplary threshold duty cycles discussed above are exemplary in nature and, therefore, are not intended to limit the scope of the disclosure to such particular values. Instead, the threshold duty cycle of step (1125) can be any suitable threshold duty cycle for determining if a vessel is present.

If D is not less than the threshold percentage at (1125), this can indicate that a vessel is not magnetically coupled with the induction heating coil. In such instance, the induction heating system can operate in a vessel-less mode at (1130) and subsequently return to step (1115). If it is determined at (1125) that D is less than the threshold percentage, then method (1100) can proceed to step (1135).

According to an aspect of the present disclosure, the calculated switching power loss ("Psw") can be classified into one of a plurality of threat zones based upon the magnitude of the switching power loss. Further, the operating frequency of the induction heating system can be adjusted based upon the threat zone into which the switching power loss is classified.

As an example, steps (1135)-(1140) can be considered a "Dangerous Zone." At (1135) the Psw is compared to a first threshold power loss. For example, the first threshold power loss can be a switching power loss value that threatens to damage the associated switching element. As an example, the first threshold power loss can be at about 11 kW for an associated IGBT.

If it is determined at (1135) that the Psw is greater than or equal to the first threshold power loss, then at (1140) the operating frequency of the induction heating system can be increased to a first frequency value. As an example, the first frequency value can be a sufficiently high frequency to ensure that the resulting switching power loss is within a safe operating area associated with the switching element, such as about 50 kHz. If, however, it is determined at (1135) of FIG. 11A that the Psw is less than the first threshold power loss, then method (1100) can proceed to step (1145) of FIG. 11B.

One of skill in the art, in light of the disclosures contained herein, will appreciate that the values associated with the first threshold power loss and the first operating frequency of steps (1135) and (1140) are dependent upon the components used in the induction heating system and their configuration. In particular, various switching elements can be used in the induction heating system and each of such switching elements can provide varying characteristics, including varying safe operating areas for associated switching power losses.

In addition, altering the induction heating coil or resonant capacitors of the induction heating system can result in varying resonance frequencies. As such, the threshold power losses and operating frequencies of method (1100) can be altered or tuned to fit the particular characteristics and properties of the components used within the induction heating system. Generally, the threshold power losses and operating frequencies of method (1100) can be determined by taking into consideration induction heating system properties including, but not limited to, resonance frequencies, input voltages, user performance expectations, user safety, expected vessel properties, and the safe operating areas associated with any included switching elements.

Referring now to FIG. 11B, steps (1145)-(1155) can be considered a "Warning Zone." At (1145) the Psw is compared to a second threshold power loss. As an example, in the instance in which the first threshold power loss is at about 11 kW, the second threshold power loss can be at about 10.3 kW. If it is determined at (1145) that the Psw is greater than or equal to the second threshold power loss, then method (1100) can proceed to step (1150).

At (1150) the operating frequency of the induction heating system can be increased according to a frequency step table. In particular, the frequency step table can provide a plurality of steps respectively corresponding to a plurality of operating frequency values. According to one aspect of the present disclosure, the operating frequency of the induction heating system can be increased by two steps of the frequency step table at (1150). Increasing the operating frequency by two steps can ensure that the increase in operating frequency and resulting reduction in power switching loss is significant enough as to eliminate the danger of damaging the switching element. However, increasing by only two steps rather than maximizing the operating frequency can reduce noise associated with the power output and provide a more consistent user experience.

Figure 2A:
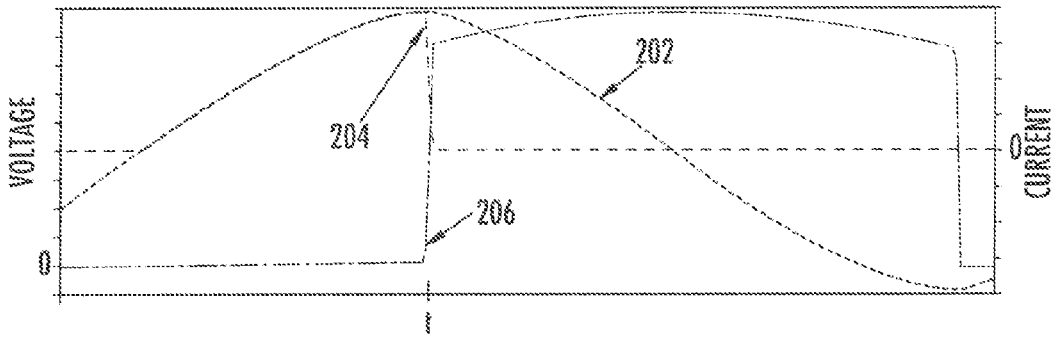
FIG. 2A provides an exemplary graphical depiction of current and voltage levels associated with a switching element and an induction heating coil of a typical known resonant power inverter circuit.
Figure 2B:
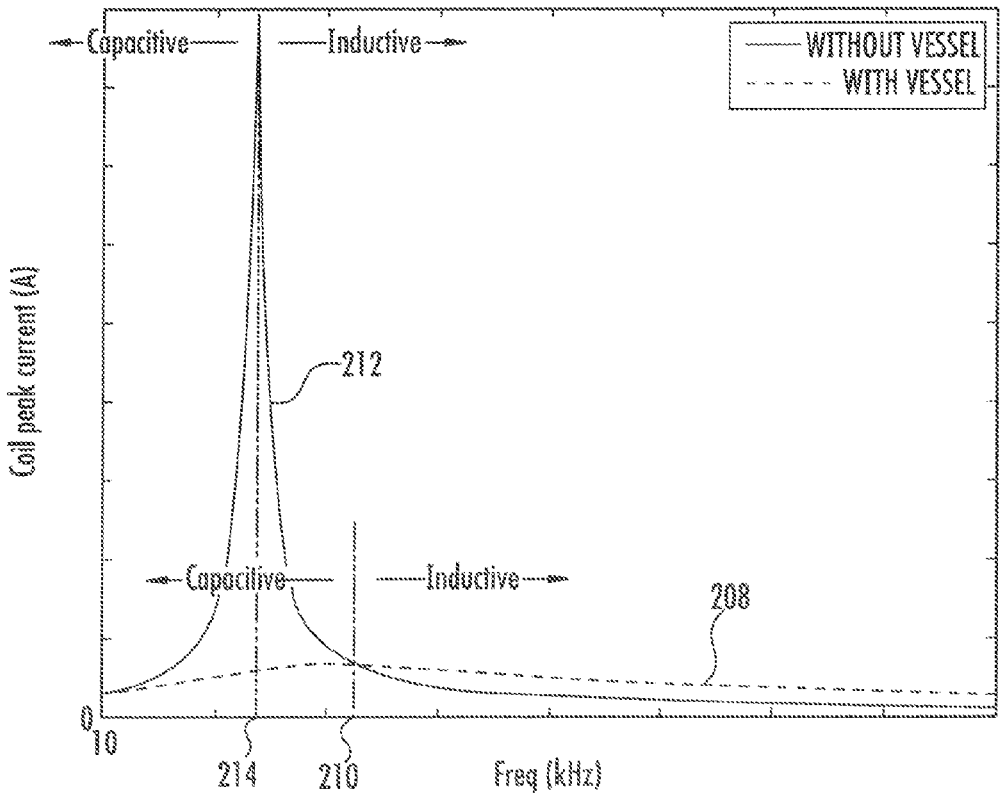
FIG. 2B provides an exemplary graphical depiction of coil current versus operating frequency of an induction heating coil with and without an associated vessel.

According to another aspect of the present disclosure, the magnitude of the increases in frequency associated with the steps of the frequency step table can increase as the operating frequency of the induction heating system is adjusted away from a resonance frequency. For example, with reference to plot 212 of FIG. 2B, it can be seen that the slope of plot 212 increases when approaching resonance frequency 214. Therefore, a smaller increase in frequency at frequencies close to resonance point 214 can result in a more significant reduction in coil peak current than a larger increase in frequency farther away from resonance point 214. As a result, the steps of the frequency table can become increasingly distant from each other as the operating frequency is adjusted away from the resonance frequency.

Returning to FIG. 11B, at (1155) the system flag can be set to a different indicator level. For example, the system flag can be set to 'Yellow.' As will be discussed further, setting the system flag to 'Yellow' can indicate that the Psw should be monitored until it falls below a third threshold power loss. After the system flag has been set to 'Yellow' at (1155), method (1100) can return to step (1115) of FIG. 11A.

If it is determined at (1145) that the Psw is less than the second threshold power loss, then method (1100) can proceed to step (1160). As an example, steps (1160)-(1175) can be considered a "Buffer Zone." At (1160) it is determined whether the system flag is currently set to 'Yellow.' If it is determined at (1160) that the system flag is currently set to 'Yellow' then at (1165) the Psw can be compared to a third threshold power loss. As an example, the third threshold power loss can be at about 9.7 kW.

If it is determined at (1165) that the Psw is less than the third threshold power loss, then at (1170) the system flag can be returned to 'Green' and the method can return to step (1115) of FIG. 11A. If it is determined at (1165) that the Psw is not less than the third threshold power loss, then at (1175) the system flag is maintained as 'Yellow' and the method can return to step (1115) of FIG. 11A. In such fashion, steps (1160)-(1175) can provide a buffer zone in which the 'Yellow' system flag is maintained until the Psw falls below the third threshold power loss.

If it is determined at (1160) that the system flag is not set to 'Yellow' then the induction heating system can be operated in a default or normal mode at (1180). For example, step (1180) can be considered a "Normal Zone." In one implementation, operating the induction heating system in the normal operating mode includes adjusting the operating frequency of the induction heating system by one step of the frequency step table until a desired output power of the induction heating system is obtained.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating an induction heating system, the method comprising:

calculating a switching power loss associated with a switching element of the induction heating system, the switching element being a component of a power supply circuit configured to supply a power signal to an induction heating coil of the induction heating system at an operating frequency; and adjusting the operating frequency of the induction heating system based at least in part on the switching power loss.

2. The method of claim 1, wherein the operating frequency of the induction heating system is adjusted such that the switching power loss is within a safe operating area associated with the switching element.

3. The method of claim 1, wherein adjusting the operating frequency of the induction heating system based at least in part on the switching power loss comprises:

classifying the switching power loss into one of a plurality of threat zones based upon the magnitude of the switching power loss; and adjusting the operating frequency of the induction heating system based upon the threat zone into which the switching power loss is classified.

4. The method of claim 1, wherein calculating a switching power loss associated with a switching element of the induction heating system comprises:

detecting a feedback signal in the induction heating system, the feedback signal being associated with a signal flowing through the induction heating coil;

comparing the feedback signal to a reference signal to generate an output signal having a duty cycle, the duty cycle of the output signal being based at least in part on a percentage of the feedback signal that is greater or less than the reference signal, the duty cycle of the output signal corresponding to the proximity of the operating frequency to resonance; and calculating the switching power loss associated with the switching element based at least in part on the duty cycle of the output signal.

5. The method of claim 4, wherein the feedback signal comprises a voltage across a shunt resistor in a path of the signal flowing through the induction heating coil.

6. The method of claim 4, wherein calculating the switching power loss associated with the switching element based at least in part on the duty cycle of the output signal comprises:

determining an input voltage of the power signal supplied to the induction heating coil;

determining a coil current flowing through the induction heating coil; and calculating the switching power loss associated with the switching element based upon the input voltage, the coil current, and the duty cycle of the output signal.

7. The method of claim 6, wherein determining a coil current flowing through the induction heating coil comprises:

determining a shunt current flowing through a shunt resistor, the shunt resistor being in a path of the signal flowing through the induction heating coil; and calculating the coil current flowing through the induction heating coil based upon the shunt current and the duty cycle of the output signal.

8. The method of claim 1, wherein adjusting the operating frequency of the induction heating system based at least in part on the switching power loss comprises:

comparing the switching power loss to a first threshold loss value; and increasing the operating frequency of the induction heating system to a first frequency value when the switching power loss is greater than or equal to the first threshold loss value.

9. The method of claim 8, wherein adjusting the operating frequency of the induction heating system based at least in part on the switching power loss further comprises:

comparing the switching power loss to a second threshold loss value when the switching power loss is less than the first threshold loss value, the second threshold loss value being less than the first threshold loss value;

increasing the operating frequency of the induction heating system according to a frequency step table when the switching power loss is greater than or equal to the second threshold loss value but less than the first threshold loss value, the frequency step table providing a plurality of steps respectively corresponding to a plurality of operating frequency values; and setting a system flag to a first indicator level when the switching power loss is greater than or equal to the second threshold loss value.

10. The method of claim 9, wherein the operating frequency of the induction heating system is increased by two steps of the frequency step table when the switching power loss is greater than or equal to the second threshold loss value but less than the first threshold loss value.

11. The method of claim 9, wherein adjusting the operating frequency of the induction heating system based at least in part on the switching power loss further comprises:

comparing the switching power loss to a third threshold loss value when the system flag is set to the first indicator level, the third threshold loss value being less than the second threshold loss value;

setting the system flag to a second indicator level when the switching power loss is less than the third threshold loss value; and operating the induction heating system in a normal operating mode when the system flag is set to the second indicator level.

* * * * *